United States Patent [19]

Kemerer

[11] Patent Number: 4,708,807

[45] Date of Patent: Nov. 24, 1987

[54] CLEANING AND WATERPROOFING COMPOSITION

[75] Inventor: Beverly K. Kemerer, Saginaw Township, Saginaw County, Mich.

[73] Assignee: Dow Corning Corporation, Midland, Mich.

[21] Appl. No.: 857,659

[22] Filed: Apr. 30, 1986

[51] Int. Cl.[4] ..... D06M 1/00

[52] U.S. Cl. ..... 252/8.6; 252/142; 252/174.15; 428/266; 8/DIG. 5

[58] Field of Search ..... 252/8.6, 174.15, 142; 8/DIG. 5; 428/266

[56] References Cited

U.S. PATENT DOCUMENTS

| | | | |
|---|---|---|---|
| 2,672,455 | 3/1954 | Currie | 525/475 |
| 2,732,320 | 1/1956 | Guillissen et al. | 8/128.3 |
| 3,123,494 | 3/1964 | Charreau | 8/142 |
| 4,122,029 | 10/1978 | Gee et al. | 252/309 |
| 4,501,682 | 2/1985 | Goodman et al. | 252/174.15 |

*Primary Examiner*—Paul Lieberman
*Assistant Examiner*—John F. McNally
*Attorney, Agent, or Firm*—Alexander Weitz

[57] ABSTRACT

A composition and method for cleaning and waterproofing fabrics and textiles is disclosed. The composition comprises a siloxane resin copolymer, a polydimethylsiloxane fluid, a titanate ester and a dimethylsiloxane-oxyalkylene block copolymer dispersed in a major portion of a solvent selected from volatile cyclic dimethylsiloxanes, petroleum hydrocarbons, chlorinated hydrocarbons, aromatic hydrocarbons or mixtures thereof.

29 Claims, No Drawings

CLEANING AND WATERPROOFING COMPOSITION

This invention relates to an improved cleaning and waterproofing composition for fabrics and textiles. This invention further relates to a method for using the improved composition to remove soils from a fabric and to provide a water-repellent character to said fabric.

BACKGROUND OF THE INVENTION

The use of solvents, such as hydrocarbons and chlorinated hydrocarbons, is well known in the dry cleaning art. It is also known to impart water repellency to fabrics and leathers by applying thereto various silicone fluid and resin compositions. Thus, for example, in U.S. Pat. No. 2,672,455, Currie teaches a composition of matter comprising a hydrolyzable titanate ester, a methyl polysiloxane copolymer composed of trimethylsiloxane units and $SiO_2$ units, said units being in such proportion that the ratio of methyl radicals to silicon atoms is from 1.0:1 to 2.5:1, and a polysiloxane (generally a polydimethylsiloxane fluid). Solutions of such compositions were used by Currie to impregnate leather in order to produce a water-repellent surface. Similar compositions were later used in the art to treat various fabrics to achieve waterproofing character thereon.

Solvent and silicone combinations have been employed in the art to simultaneously clean and waterproof (protect) fabrics and other surfaces. By way of example, in U.S. Pat. No. 3,123,494, Charreau discloses a process for dry cleaning contaminated textile articles with a composition comprising a solvent, selected from hydrocarbons or chlorinated hydrocarbons, a methylpolysiloxane waterproofing agent and an alkyl titanate. The methylpolysiloxane in this case is preferably selected from dimethyl polysiloxane resins or methylhydrogen polysiloxane resins, said resins being mixed with at least one fluid selected from liquid dimethyl polysiloxane or liquid methyl hydrogen polysiloxane. The process comprises immersing a contaminated textile in said composition, agitating the textile sufficiently to cause foam formation, separating the thus cleaned textile from the composition and foam, removing adherent solvent and drying the textile, thereby retaining from 2 to 3 percent of said methylpolysiloxane on the textile, which imparts the waterproofing character. In this instance, improved cleaning action was believed to result from foam generated in the solvent by inclusion of the methylpolysiloxane.

In a more recent disclosure, U.S. Pat. No. 4,501,682, Goodman et al. teaches a cleaning and protective composition consisting of an admixture of poly(methylhydrosiloxane), tin octoate and zinc octoate in at least one solvent. The solvent in this case is selected from cyclic or linear polydimethylsiloxanes, petroleum distillates, methylene chloride, or mixtures thereof.

Kasprzak, in a copending application, Ser. No. 670,195, filed Nov. 13, 1984 and assigned to the assignee of the present invention, has shown that perchloroethylene can be combined with cyclic dimethyl siloxanes to produce synergistic cleaning effects in removing stains of oil, grease or sebum from textiles.

Although the cleaning compositions comprising various solvents and the waterproofing compositions comprising siloxane resins perform their respective functions effectively when applied separately (or sequentially), there is still a need for an improved composition which would combine the cleaning and waterproofing results. Such combination of the cleaning and waterproofing functions in one composition is desirable since the number of steps required to perform both operations is reduced. Thus, for example, when compositions similar to those described by Charreau, supra, are applied to a fabric having an oil or grease stain thereon, inadequate cleaning of the stain is observed.

It has now been found that, over a certain composition range, inclusion of a relatively small amount of a siliconeoxyalkylene copolymer in a composition comprising a siloxane resin copolymer, a polydimethylsiloxane fluid, a titanate es ter and a volatile cyclic polydimethylsiloxane, provides significant improvement with respect to stain removal while still imparting good water repellency to a fabric treated therewith.

SUMMARY OF THE INVENTION

This invention relates to a cleaning and waterproofing composition, comprising:

(a) from about 1.5 to about 4.5 parts by weight of a siloxane resin selected from the group consisting of a silanol-functional copolymer consisting essentially of $SiO_2$ units and $(CH_3)_3SiO_{\frac{1}{2}}$ units in a molar ratio ranging from 1:0.4 to 1:1.2 and a trimethysilyl-capped copolymer consisting essentially of $SiO_2$ units and $(CH_3)_3SiO_{\frac{1}{2}}$ units in a molar ratio ranging from 1:0.4 to 1:1.2;

(b) from about 1.5 to about 4.5 parts by weight of a polydimethylsiloxane fluid having a viscosity from 5 to 100,000 cS at 25° C.;

(c) from about 1.0 to about 3.0 parts by weight of a titanate ester represented by the formula $$Ti(OR)_4$$

wherein R is independently selected from alkyl radicals having 3 to 8 carbon atoms;

(d) from about 0.5 to about 3.0 parts by weight of a polydimethylsiloxane-polyoxyalkylene block copolymer wherein said polydimethylsiloxane block has a molecular weight from 10,000 to 50,000, said polyoxyalkylene block is a copolymer of ethylene oxide units and propylene oxide units wherein the polypropylene content is between 0 and 50% on a molar basis, and wherein the weight ratio of said polydimethylsiloxane block to said polyoxyalkylene block is between 2 and 8;

(e) up to about 95.5 parts by weight of at least one cyclic dimethyl siloxane selected from the group consisting of octamethylcyclotetrasiloxane, decamethylcyclopentasiloxane and dodecamethylcyclohexasiloxane; and (f) up to about 95.5 parts by weight of at least one solvent selected from the group consisting of petroleum hydrocarbons, chlorinated hydrocarbons and aromatic hydrocarbons, said solvent being present in such amount that the sum of components (a) through (f) in the composition is 100 parts.

This invention further relates to a method for cleaning and waterproofing textiles comprising: applying to a soiled textile an effective amount of a liquid to aid soil removal, removing from the textile a combination of soil and the liquid and drying the textile, wherein said liquid is the composition described hereinabove.

DETAILED DESCRIPTION OF THE INVENTION

This invention relates to a composition for cleaning and waterproofing fabrics and textiles, comprising (a) a siloxane resin copolymer, (b) a polydimethylsiloxane fluid, (c) a titanate ester, (d) a diorganosiloxane-oxyalkylene block copolymer, and (e) a cyclic dimethylsiloxane. Additionally, in the preferred embodiments, other common solvents (f) may be present, perchloroethylene being particularly effective.

It has unexpectedly been found that when component (d) is selected from a narrow range of block copolymers, described in full hereinbelow, and included at specific levels, improved cleaning of stained fabrics and textiles results from use of such compositions relative to those which do not include said block copolymer. Moreover, even though the copolymers of component (d) contain hydrophilic polyoxyalkylene blocks, which would be expected to deteriorate waterproofing character, it has been found that the compositions of this invention still impart adequate water repellency to fabrics and textiles treated therewith.

Component (a) of the instant invention is a siloxane resin copolymer consisting essentially of $SiO_2$ units and $(CH_3)_3SiO_{\frac{1}{2}}$ units in a molar ratio ranging from 1:0.4 to 1:1.2. The preferred ratio of these units in the siloxane resin copolymer is approximately 1:0.75. Silanol-functional siloxane resin copolymer may be prepared by methods known in the art, as described by, inter alia, Daudt et al. in U.S. Pat. No. 2,676,182, hereby incorporated by reference. For the purpose of this invention, the residual silanol groups left on the silanol-functional siloxane resin copolymer after preparation by such a process may be capped with trimethylsilyl groups by techniques familiar to those skilled in the art. For example, the silylation may be effected by reaction with such agents as hexamethyldisilazane or N,O-Bis(trimethylsilyl)acetamide. Both the preparation and silylation of the resin take place in a solvent, such as xylene or toluene, and this solvent, which typically represents about 30–35% by weight of the resin solution, is ordinarily retained when formulating the compositions of this invention.

Within the scope of this invention, component (a) constitutes from about 1.5 to about 4.5 parts by weight of the total cleaning and waterproofing composition, preferably from about 2.0 to about 3.5 parts.

Component (b) of this invention is a polydimethylsiloxane fluid having a viscosity from about 5 to about 100,000 cS at 25° C. Preferred fluids are terminated with trimethylsilyl groups, but a silanol group, or any inert end group, would function equally well. These fluids are well known in the art, available commercially and need no further description herein. Preferred fluid has a viscosity of about 100 to about 1000 cS at 25° C., a viscosity of about 350 cS being most preferred.

Within the scope of this invention, component (b) constitutes from about 1.5 to about 4.5 parts by weight of the total cleaning and waterproofing composition, preferably from about 2.0 to about 3.4 parts.

Component (c) of this invention is a titanate ester having the formula $$Ti(OR)_4$$

wherein R is independently selected from lower alkyl groups having 3 to 8 carbon atoms, such as propyl, isopropyl, butyl and 2-ethylhexyl, preferably isopropyl or 2-ethylhexyl. These materials are known in the art and need not be further described herein.

Within the scope of this invention, component (c) constitutes from about 1.0 to about 3.0 parts by weight of the total cleaning and waterproofing composition, preferably from about 1.5 to about 2.4 parts. When the R group of component (c) is isopropyl, it is preferred to add from about 0.6 to about 1.0 parts by weight of 2-ethyl-1,3-hexanediol to the compositions of this invention to stabilize the titanate ester.

Component (d) of this invention is a silicone-oxyalkylene block copolymer of the end-to-end or pendant ("rake" structure) type, fully described as component (d) in U.S. Pat. No. 4,122,029, hereby incorporated by reference. For the purposes of this invention, these copolymers comprise polydimethylsiloxane blocks connected to polyoxyalkylene blocks through either Si—O—C or Si—C bonds. The polydimethylsilo blocks employed should have a molecular weight ranging from about 10,000 to about 50,000, a value of about 30,000 being preferred.

The polyoxyalkylene block is selected from polyoxyethylene or a copolymer of polyoxyethylene and polyoxypropylene, wherein the polyoxypropylene content can vary from 0 to 50% on a molar basis and the total average molecular weight is at least 1000, a range between 2200 and 2550 being preferred. Component (d) may have said polydimethylsiloxane coupled to said polyoxyalkylene in a weight ratio of from 2:1 to 8:1, a range of 2.5:1 to 4:1 being preferred.

The most preferred embodiment of component (d) is a copolymer wherein the polyoxyalkylene blocks are pendant to the polydimethylsiloxane chain, said ratio of polydimethylsiloxane to polyoxyalkylene is about 2.7:1, the molecular weight of the polydimethylsiloxane block is approximately 30,000, the polyoxyalkylene block is a random copolymer which contains equimolar amounts of ethylene oxide and propylene oxide units and has a total average molecular weight of about 2550.

Preparation of these copolymers is well known in the art. For example, Si—O—C—bonded copolymers may be formed by reacting a polydiorganosiloxane bearing silicon-bonded hydrolyzable radicals, such as SiH, with a hydroxyl-bearing polyoxyalkylene. Formation of the reaction product is facilitated by the use of a catalyst known to promote the SiH-carbinol condensation reaction, examples of such catalysts being chloroplatinic acid and metal salts such as stannous octoate. Si—C—bonded copolymers may be formed by reacting a polydiorganosiloxane bearing SiH functionality with polyoxyalkylenes terminated with vinylic unsaturation at one end. This reaction is generally catalyzed by platinum complexes. The Si—H—bonded copolymer is preferred since it is known to be hydrolytically stable relative to the Si—O—C type bonding.

Within the scope of this invention, component (d) constitutes from about 0.5 to about 3.0 parts by weight of the total cleaning and waterproofing composition, preferably from about 0.5 to about 1.3 parts.

Component (e) of this invention is a cyclic dimethylsiloxane or a blend of cyclic dimethylsiloxanes. These materials are available commercially and may be prepared by well known methods such as, for example, the hydrolysis and condensation of dimethyldichlorosilane. Preferred cyclic dimethylsiloxanes are octamethylcyclotetrasiloxane, decamethylcyclopentasiloxane and dodecamethylcyclohexasiloxane. A particularly preferred blend comprises about 91% by weight of the cyclic tetramer and about 8% by weight of the cyclic pentamer, the remainder being lower and higher cyclic dimethylsiloxanes.

Within the scope of this invention, component (e) constitutes from 0 to about 95.5 parts by weight of the total cleaning and waterproofing composition, preferably from about 4 to about 90 parts.

In addition to the components (a) through (e), above, the compositions of this invention can contain from 0 to about 95.5 parts by weight of component (f), a conventional cleaning solvent employed to aid in soil removal and to act as vehicle for the non-volatile components. Component (f) is added to components (a) through (e) such that the total, on a weight basis, of components (a) through (f) is 100 parts. Thus, any of the solvents used in the dry cleaning arts may be incorporated herein. Examples of such solvents include petroleum hydrocarbons, such as mineral spirits and Stoddard Solvent, chlorinated hydrocarbons, such as trichloroethylene and perchloroethylene and aromatic hydrocarbons, such as xylene and toluene, and mixtures thereof.

Perchloroethylene is a particularly preferred solvent which imparts improved cleaning ability. Within the scope of this invention, perchloroethylene preferably constitutes up to about 80 parts by weight of the cleaning and waterproofing composition. When component (a) is a trimethylsilyl-capped copolymer, component (f) preferably consists of Stoddard Solvent, xylene and, optionally, perchloroethylene in a weight ratio ranging from about 4:1:65 to about 4:1:0 of the respective solvents. A particularly preferred form of Stoddard Solvent is a refined petroleum distillate having a boiling point of about 160° C.

The components of the composition of this invention may be combined by any standard mixing technique known in the art and no special high shear equipment need be employed. Likewise, the order of addition of the components does not appear to be critical as long as a uniform mixture results. However, it is preferred to first form a water repellent solution of components (a) through (c) in about 40% Stoddard Solvent and about 8% xylene, based on total weight of said solution. Components (d) and (e) may be mixed together till uniform and a solvent, preferably perchloroethylene, added while stirring. Said water repellent solution can then be introduced and further mixed till uniform. Typically, when this procedure was followed, the compositions of this invention were clear to slightly hazy in appearance.

The compositions of this invention may also contain a fluorochemical compound known in the art to impart oil repellency to textiles and fabrics. Examples of these compounds include carboxylate esters of perfluoroalkyl aliphatic alcohols, fluorinated organic carboxylic acids, fluoroalkyl-containing carbodiimide and fluoroalkyl-containing poly(oxyalkylenes). The fluoroalkyl portions of these compounds typically contain from 3 to 20 carbon atoms. Addition of from about 0.5 to about 5 parts by weight of such a fluorochemical compound to the compositions of this invention results in a cleaning and protecting fluid which, in addition to imparting water repellency, provides oleophobic character (i.e., oil repellency) to a fabric or textile. The effective amount of fluorochemical compound to impart such oleophobing may be readily determined by a few simple experiments by those of ordinary skill in the art.

The compositions of this invention may further contain other adjuvants commonly employed in the cleaning and waterproofing arts. Examples of such additional components include, but are not limited to, synthetic builders, antistatic agents and absorbent solid particulate materials. Examples of absorbent solid materials include silica, talc, diatomaceous earth, kaolinite, starch, nut shell flour, ground rice hulls and urea-formaldehyde polymer particles. These materials, when present, constitute from 5 to 40% by weight of the solvent content of the cleaning and waterproofing composition.

This invention also relates to a method of cleaning and waterproofing fabrics and textiles such that, upon removal of a stain or spot from said textile or fabric, these materials are rendered water repellent.

The compositions of the present invention may be used in an immersion procedure wherein a soiled fabric is dipped and agitated with the composition, similar to the process described by Charreau, supra. The compositions may also be applied directly to stains and soils on fabrics and other textiles. They can be applied by any of the commonly used methods known in the art. The compositions may be poured or sprayed onto the stains, the excess of said composition being drained away. Alternatively, they may be brushed or rubbed onto the stained or soiled area using absorbent items such as brushes, paper towels, cloth or sponges that contain the cleaning and waterproofing composition.

Once the cleaning and waterproofing composition has been applied to the soiled textile, the cyclic siloxane and other solvents act to dissolve and/or loosen the soil which it contacts. The mobilized soil is then more easily removed from the textile in combination with the cleaning and waterproofing composition. Examples of convenient removal means include such techniques as blotting the textile with a dry absorbent material such as sponge, paper towel or cloth towel, or brushing or vacuuming, if solid absorbent particles are employed in the composition.

After removal of the soil/cleaning and waterproofing composition combination, the textile is allowed to dry at ordinary or elevated temperatures. The cyclic siloxane(s) and solvent(s) evaporate from the textile, leaving the resin and other non-volatile components in the textile, whereby a water repellent surface is imparted to said textile.

The method of this invention can be used to remove a wide variety of soils and stains. It is particularly effective in removing oil and grease spots or stains. One special advantage of employing the cyclic siloxanes as the cleaning solvent (or part of the cleaning solvent) is that the formation of a secondary stain ring is greatly reduced or eliminated entirely. Another advantage is that the cyclic siloxanes are essentially non-toxic and non-harmful in the environment.

The compositions of the present invention can be used with a wide variety of fabrics without harming or in any way changing the appearance of the fabric. The "hand" or feel of the fabric, for example, remains soft and natural after treating the fabric with these compositions as opposed to a harsh, stiff and waxy feel imparted to fabrics treated with a commercial fluorocarbon material, Scotch-gard ® Upholstery Cleaner and Protector (3M Co., Minneapolis, MN).

The method of cleaning and waterproofing of this invention can be used on all types of textiles including carpets and fabrics used for clothing or upholstery, such as velour and "crushed" velour. Examples of textile and fabric compositions which may be cleaned and protected with the compositions of this invention include, but are not limited to, cotton, cotton-polyester blends, wool, nylon, Dacron, Orlon and glass.

EXAMPLES

The following examples are included to illustrate the compositions of this invention and the methods of using said compositions. The examples are not to be construed as limiting the invention, which is defined by the appended claims. All parts and percentages in the examples are on a weight basis unless indicated to the contrary.

Preparation A

A water repellent blend was prepared by mixing (at room temperature) 12.0 parts of tetraisopropyltitanate, 4.7 parts of 2-ethyl-1,3-hexanediol, 16.7 parts of a linear polydimethylsiloxane oil having a viscosity of about 350 cS at 25° C., 39.6 parts of Stoddard Solvent (boiling point =157° C., Kauri Butanol value =33) and 27.0 parts of an approximately 64% solution in xylene of a trimethylsilyl-endblocked siloxane resin copolymer consisting essentially of $SiO_2$ units and $(CH_3)_3SiO_{\frac{1}{2}}$ units in a molar ratio of approximately 1:0.75. The siloxane resin copolymer, in turn, was prepared from a silanol-functional resin having a similar composition, and prepared according to the methods described by Daudt et al. in U.S. Pat. No. 2,676,182, cited supra. The trimethylsilyl-endblocked resin used herein was prepared by capping the silanol groups of the latter resin with hexamethyldisilazane. The resultant blend will be referred to as "Preparation A" in the examples which follow.

Preparation B

A polydimethylsiloxane-polyoxyalkylene block copolymer was prepared according to the method described in Example 1 of U.S. Pat. No. 4,122,029, hereby incorporated by reference. The polydimethylsiloxane block of this copolymer had a molecular weight of approximately 30,000 and, on average, about 4 polyoxyalkylene blocks attached to the polydimethylsiloxane block per molecule. The polyoxyalkylene block, in turn, was a random equimolar copolymer of ethylene oxide and propylene oxide, had an average molecular weight of approximately 2550 and was terminated with hydroxyl groups. Ten and one half parts of the above copolymer was mixed with 87.6 parts of a blend of polydimethylcyclosiloxane fluids (described infra as "Preparation C") and 1.9 parts of water. The addition of water was found to help prevent settling of unreacted polyoxyalkylene blocks. This combination was mixed for 1 hour at room temperature and then filtered. The resultant mixture will be referred to as "Preparation B" in the examples which follow.

Preparation C

A blend of cyclic siloxane fluids, comprising approximately 91% octamethylcyclotetrasiloxane and approximately 8% decamethylcyclopentasiloxane, was prepared and will be referred to as "Preparation C" in the examples which follow.

Preparation D

A water repellent blend was prepared by mixing (at room temperature) 29.2 parts of tetrakis 2-ethylhexyl titanate, 29.2 parts of a linear polydimethylsiloxane oil having a viscosity of about 350 cS at 25° C., and 41.7 parts of a 70% solution in xylene of a silanol-functional siloxane resin copolymer similar to the silylated resin of Preparation A, but one which was not capped with trimethylsilyl groups. The resultant blend will be referred to as "Preparation D" in the examples which follow.

Preparation E (Comparison)

A polydimethysiloxane-poly(ethylene oxide) block copolymer was prepared, according to the method of Preparation B, wherein the molecular weight of the polydimethylsiloxane portion was about 850 and the molecular weight of the poly(ethylene oxide) block was approximately 1200. In this copolymer, the weight ratio of the polydimethylsiloxane block to the poly(ethylene oxide) blocks was approximately 0.4. This composition will be referred to as "Preparation E" in the examples which follow. Preparation E is not within the scope of this invention and is included for comparative purposes only.

Preparation F (Comparison)

A siloxane-polyoxyalkylene copolymer having the average structure represented by the formula $$(CH_3)_3SiO(\overset{\overset{CH_3}{|}}{\underset{\underset{R}{|}}{Si}}O)_{38.7}(\overset{\overset{CH_3}{|}}{\underset{\underset{Q}{|}}{Si}}O)_{1.3}Si(CH_3)_3$$

wherein R is the dodecyl group and Q has the average formula $$-(CH_2)_3(OCH_2CH_2)_{19}(OCHCH_3CH_2)_{19}OH.$$

This copolymer was prepared according to the methods of Example 2 of U.S. Pat. No. 4,532,132, hereby incorporated by reference. This preparation will be referred to as "Preparation F" in the examples which follow. Preparation F is not within the scope of this invention and is included for comparative purposes only.

Examples 1–12

Various amounts of the above preparations were combined with perchloroethylene as follows. Preparation C was placed into a mixing vessel and Preparation B (or Preparation E or F) was added with agitation and blended till uniform. Agitation was continued while the appropriate amount of perchloroethylene was added. When this mixture was uniform, Preparation A (or Preparation D) was blended in till, again, a uniform mixture resulted. The compositions of this invention, as well as comparative ones, are summarized in Table 1. Additionally, the compositions of Table 1 are reported in terms of the individual components, (a) through (f), in Table 1*a*. The sum of (a) through (f) in each example is 100 parts and the last column of Table 1*a* represents 2-ethyl-1,3,hexanediol and water, introduced by inclusion Preparations A and B, respectively.

TABLE 1

| | Compositions of this Invention and Comparative Compositions | | | | | | |
|---|---|---|---|---|---|---|---|
| | Component (Parts by Weight) | | | | | | |
| | Preparation A | Preparation B | Preparation C | Preparation D | Preparation E | Preparation F | Perchloro-ethylene |
| Example No. (Instant Invention) | | | | | | | |
| 1 | 12.5 | 8.3 | 62.5 | — | — | — | 16.7 |
| 2 | 12.5 | 5.0 | 65.8 | — | — | — | 16.7 |
| 3 | 12.5 | 12.0 | 58.8 | — | — | — | 16.7 |
| 4 | 20.0 | 8.3 | 55.0 | — | — | — | 16.7 |
| 5 | 12.5 | 8.3 | 79.2 | — | — | — | — |
| 6 | 12.5 | 8.3 | 10.0 | — | — | — | 69.2 |
| 7 | 12.5 | 8.3 | — | — | — | — | 79.2 |
| 8 | — | 8.3 | 68.1 | 6.9 | — | — | 16.7 |
| (Comparative) Example No. | | | | | | | |
| 9 | 1.0 | 8.3 | 74.0 | — | — | — | 16.7 |
| 10 | 7.5 | 8.3 | 67.5 | — | — | — | 16.7 |
| 11 | 12.5 | — | 70.0 | — | 0.8 | — | 16.7 |
| 12 | 12.5 | — | 70.0 | — | — | 0.8 | 12.7 |

TABLE 1a

| | Compositions of Table 1 Recalculated in Terms of Individual Components (Parts by Weight) | | | | | | |
|---|---|---|---|---|---|---|---|
| | Siloxane Resin Component a | Siloxane Fluid Component b | Titanate Ester Component c | Block Copolymer Component d | Cyclic Siloxane Component e | Solvent Component f | Additional Components(1) |
| Example No. (Instant Invention) | | | | | | | |
| 1 | 2.18 | 2.10 | 1.51 | 0.88 | 70.30 | 23.04 | 0.75 |
| 2 | 2.18 | 2.10 | 1.51 | 0.53 | 70.66 | 23.02 | 0.69 |
| 3 | 2.18 | 2.11 | 1.51 | 1.27 | 69.89 | 23.05 | 0.82 |
| 4 | 3.50 | 3.38 | 2.43 | 0.88 | 62.96 | 26.86 | 1.11 |
| 5 | 2.18 | 2.10 | 1.51 | 0.88 | 87.12 | 6.21 | 0.75 |
| 6 | 2.18 | 2.10 | 1.51 | 0.88 | 17.40 | 75.93 | 0.75 |
| 7 | 2.18 | 2.10 | 1.51 | 0.88 | 7.33 | 86.01 | 0.75 |
| 8 | 2.02(2) | 2.02 | 2.02 | 0.87 | 75.49 | 17.58 | 0.16 |
| (Comparative) Example No. | | | | | | | |
| 9 | 0.17 | 0.17 | 0.12 | 0.87 | 81.43 | 17.23 | 0.21 |
| 10 | 1.31 | 1.26 | 0.90 | 0.88 | 75.15 | 20.50 | 0.51 |
| 11 | 2.18 | 2.10 | 1.51 | 0.80(3) | 70.42 | 23.00 | 0.59 |
| 12 | 2.18 | 2.10 | 1.51 | 0.80(4) | 70.42 | 23.00 | 0.59 |

(1)2-ethyl-1,3,hexanediol, introduced by Preparation A, and water, introduced by Preparation B.
(2)Resin is not silylated; see Preparation D.
(3)Copolymer is Preparation E.
(4)Copolymer is Preparation F.

The following procedures were employed to determine the cleaning ability and water repellency imparted by the compositions of this invention.

In each case, "burnt" motor oil (i.e., used engine oil taken from an automobile) was applied to either a beige-colored 100% cotton muslin or a pink-colored 50/50 cotton/polyester fabric. A spot (oil stain), having a diameter of about ¾ of an inch, was thus applied at the center of a 3"×5" fabric strip. These stained fabrics were allowed to dry on a flat surface for a minimum of 2 days, at room temperature, whereupon the stains were considered "set."

Cleaning of the set stain from the fabric strip was accomplished by folding a common laboratory paper towel into a 2"×2" rectangular section and saturating the fabric-towel combination with the respective cleaning-protecting composition by inverting a bottle of said composition while holding said fabric-towel combination over the mouth of the bottle. The fabric was then placed onto a second paper towel on a flat surface and rubbed with the first (folded) paper towel, using a back-and-forth motion, for about 2 minutes. The stained fabric was re-saturated with the cleaning-protecting composition during this 2 minute period if the stain was not readily removed with only one saturation. The cleaned fabrics were subsequently allowed to dry for 24 hours while hanging on a line in a laboratory hood (i.e., at room temperature). In a comparative example, the commercial upholstery cleaner and protector, Scotch-gard® (3M Co., Minneapolis, Minn.) was employed. This product is a proprietary fluorocarbon composition containing 2-butoxy ethanol, isopropyl alcohol, and a hydrocarbon propellent. The Scotch-gard® was first de-foamed in a covered glass jar prior to cleaning soiled fabric so as to more closely duplicate the form of the liquid compositions of this invention.

Results were rated on a relative scale of 1 to 3, 1 being best and 3 being judged as poor. These results are presented in Table 2 for the compositions of this invention as well as for comparative examples.

Determination of water repellency of the above cleaned and dried samples was carried out by placing a 3–4 mm diameter drop of water near the area defining the remains of the stain, but just outside said area. These results were also rated on a relative scale of 1 to 3, 1 being best and 3 being judged as poor in terms of water repellency. In all cases, the water drop was observed to first flatten from its normally rounded shape, and then completely soak into the fabric. The respective times for the latter occurrence were noted and are also reported in Table 2 as $T_{(s)}$.

All the above compositions of this invention exhibited equal or better cleaning ability relative to Scotch-gard ®. Water repellency imparted by at least one embodiment of this invention (i.e., Example 1) was superior to that obtained with Scotch-gard ® when the fabric consisted of 100% cotton. Furthermore, in a "blind" (i.e., non-biased) comparison of fabric hand by three individuals, the fabrics treated with the compositions of the instant invention were judged to have a "soft and natural" feel, while the Scotch-gard ® treated fabrics were described as having a "stiff and waxy" feel.

Examples 13–16

Mixtures similar to those of Examples 1–12 were prepared using the same blending procedures except that the perchloroethylene solvent was not included. These compositions were likewise tested by the above-mentioned techniques for cleaning performance and water repellency. The compositions of these examples and test results appear in Table 3. Again, Table 3*a* is provided to show the compositions of Table 3 in terms of the individual components (a) through (f). In this case, the results are an internally consistent comparison of the examples in this table and were not compared with the results reported in Table 2, above, wherein improved cleaning was observed when the perchloroethylene was included. Example 16 illustrates the relatively poor cleaning results that were obtained when one of the components of this invention was excluded (i.e., component (d), as introduced in Preparation B, omitted). It can be seen from Table 3 that even though water repellency is reduced when component (d) is included in the compositions, adequate waterproofing is still provided to the fabrics.

TABLE 2

Cleaning Performance and Water Repellency of the Compositions of Table 1

| | Cleaning Performance on Fabric[1] | | Water Repellency of Dried Fabric[1] | | | |
|---|---|---|---|---|---|---|
| | | | 100% Cotton | | 50/50 Cotton/Polyester Blend | |
| | 100% Cotton | 50/50 Cotton/Polyester Blend | Rating | $T_s$ | Rating | $T_s$[2] |
| Example No. (Instant Invention) | | | | | | |
| 1 | 2 | 2 | 2 | 15 min. | 2 | 6–10 min. |
| 2 | 2 | 2 | — | — | 3 | — |
| 3 | 2 | 2 | — | — | 2 | — |
| 4 | 2 | 2 | — | — | 2 | — |
| 5 | 2 | 2 | — | — | 3 | — |
| 6 | 1 | 1 | — | — | 2 | — |
| 7 | 1 | 1 | — | — | 2 | — |
| 8 | 2 | 2 | — | — | 1 | — |
| (Comparative) Example No. | | | | | | |
| 9 | 3 | 3 | — | — | 3 | — |
| 10 | 2 | 3 | — | — | 3 | — |
| 11 | 2 | 3 | — | — | 3 | — |
| 12 | 3 | 3 | — | — | 2 | — |
| Scotch-gard ® | 2 | 3 | 3 | 3 min. | 1 | >10 min. |

[1]The following rating system applies to this table only: 1 = Best, 2 = Good, 3 = Poor
[2]$T_s$ = Time of bead to soak into fabric (minutes).

TABLE 3

Compositions Without Perchloroethylene and Evaluation Thereof

| | | | | Cleaning Performance on Fabric | | Water Repellency | |
|---|---|---|---|---|---|---|---|
| | Preparaion A | Preparation B | Preparation C | 100% Cotton | 50/50 Cotton/ Polyester Blend | 100% Cotton $T_s$ (min.) | Cotton/ Polyester Blend $T_s$ (min.) |
| (Instant Invention) Example No. | | | | | | | |
| 13 | 15 | 10 | 75 | Best | Best | 4 | 4 |
| 14 | 15 | 5 | 80 | Intermediate | Intermediate | >8 | >4 |
| 15 | 15 | 25 | 60 | Intermediate | Intermediate | 2 | 2 |
| (Comparative) Example No. | | | | | | | |
| 16 | 15 | — | 85 | Poor | Poor | >20 | >10 |

TABLE 3a

| Compositions of Table 3 Recalculated in Terms of Individual Components (Parts by Weight) | | | | | | | |
|---|---|---|---|---|---|---|---|
| | Component a | Component b | Component c | Component d | Component e | Component f | Additional Components[1] |
| Example No. (Instant Invention) | | | | | | | |
| 13 | 2.62 | 2.53 | 1.82 | 1.06 | 84.51 | 7.46 | 0.91 |
| 14 | 2.62 | 2.53 | 1.81 | 0.53 | 85.06 | 7.46 | 0.82 |
| 15 | 2.63 | 2.54 | 1.82 | 2.66 | 82.88 | 7.49 | 1.20 |
| (Comparative) Example No. | | | | | | | |
| 16 | 2.62 | 2.53 | 1.81 | — | 85.61 | 7.45 | 0.72 |

[1]2-ethyl-1,3,hexanediol introduced by Preparation A, and water introduced by Preparation B.

Examples 17–19

The compositions of Examples 1, 6 and 7 were compared with the Scotch-gard ® using the 50/50 cotton/polyester blend and the test methods employed above except that 10 grams of each composition was added to the center of the stained fabric which was placed on top of a paper towel. In this case, no rubbing or physical cleaning motion on the stained fabric was employed. After 24 hours of drying in this horizontal position, the fabric samples were evaluated with respect to cleaning effectiveness and water repellency, the results thereof being reported in Table 4.

TABLE 4

| Cleaning Performance and Water Repellency on 50/50 Cotton/Polyester Fabric | | | |
|---|---|---|---|
| | Composition (From Table 1) | Cleaning Performance | Water Repellency |
| Example | | | |
| 17 | Example 1 | Best cleaning; oil stain is about ½ as dark as prior to cleaning; no outer ring. | Best ($T_s > 10$ min.)[1] Sharp bead of water. |
| 18 | Example 6 | Almost equal cleaning to 1 except slight outer ring. | Sharp bead; lasted 5 min. |
| 19 | Example 7 | Almost equal cleaning to 1 except very slight outer ring. | Sharp bead; lasted 5 min. |
| (Comparative Example) | | | |
| Scotch-gard ® | | Poor cleaning; almost no improvement seen over untreated (uncleaned) fabric. Severe outer ring (very yellow). | Flat water bead from beginning of test. ($T_s$ = 10 min.) |

[1]$T_s$ = Time of bead to soak into fabric.

I claim:

1. A cleaning and waterproofing composition, comprising:

(a) from about 1.5 to about 4.5 parts by weight of a siloxane resin selected from the group consisting of a silanol-functional copolymer consisting essentially of $SiO_2$ units and $(CH_3)_3SiO_{\frac{1}{2}}$ units in a molar ratio ranging from 1:0.4 to 1:1.2 and a trimethysilyl-capped copolymer consisting essentially of $SiO_2$ units and $(CH_3)_3SiO_{\frac{1}{2}}$ units in a molar ratio ranging from 1:0.4 to 1:1.2;

(b) from about 1.5 to about 4.5 parts by weight of a polydimethylsiloxane fluid having a viscosity from 5 to 100,000 cS at 25° C.;

(c) from about 1.0 to about 3.0 parts by weight of a titanate ester represented by the formula $$Ti(OR)_4$$

wherein R is independently selected from alkyl radicals having 3 to 8 carbon atoms; (d) from about 0.5 to about 3.0 parts by weight of a polydimethylsiloxane-polyoxyalkylene block copolymer wherein said polydimethylsiloxane block has a molecular weight from 10,000 to 50,000, said polyoxyalkylene block is a copolymer of ethylene oxide units and propylene oxide units wherein the polypropylene content is between 0 and 50% on a molar basis, and wherein the weight ratio of said polydimethylsiloxane block to said polyoxyalkylene block is between 2 and 8;

(e) up to about 95.5 parts by weight of at least one cyclic-dimethyl siloxane selected from the group consisting of octamethylcyclotetrasiloxane, decamethylcyclopentasiloxane and dodecamethylcyclohexasiloxane; and (f) up to about 95.5 parts by weight of at least one solvent selected from the group consisting of petroleum hydrocarbons, chlorinated hydrocarbons and aromatic hydrocarbons, said solvent being present in such amount that the sum of components (a) through (f) in the composition is 100 parts.

2. The composition of claim 1, wherein said composition comprises from about 2.0 to about 3.5 parts of component (a), from about 2.0 to about 3.4 parts of component (b), from about 1.5 to about 2.4 parts of component (c) and from about 0.5 to about 1.3 parts of component (d).

3. The composition of claim 2, wherein said polydimethylsiloxane block of component (d) has a molecular weight of approximately 30,000, said polyoxyalkylene block is a random copolymer containing equimolar amounts of ethylene oxide and propylene oxide units, having a total average molecular weight of about 2550 and said weight ratio of polydimethylsiloxane to polyoxyalkylene is approximately 2.7:1.

4. The composition of claim 3, wherein said ratio of $SiO_2$ units to $(CH_3)_3SiO_{\frac{1}{2}}$ *units is approximately* 1:0.75.

5. The composition of claim 4, wherein component (f) is at least one solvent selected from the group consisting of perchloroethylene, Stoddard Solvent and xylene.

6. The composition of claim 5, wherein component (b) has a viscosity of about 100 to about 1,000 cS at 25° C. and component (e) comprises about 91% by weight octamethylcyclotetrasiloxane and about 8% by weight decamethylcyclopentasiloxane.

7. The composition of claim 6, wherein component (e) constitutes from about 4 to about 90 parts by weight of said composition, component (f) consists of a petroleum distillate having a boiling point of about 160° C., xylene and, optionally, perchloroethylene in a weight ratio ranging from about 4:1:65 to about 4:1:0, said R group of component (c) is isopropyl and said siloxane resin is a trimethylsilyl-capped copolymer, said composition further comprising from about 0.6 to about 1.0 part by weight of 2-ethyl-1,3-hexanediol.

8. The composition of claim 7, wherein said composition comprises about 2.2 parts of component (a), about 2.1 parts of component (b), about 1.5 parts of component (c), about 0.9 parts of component (d) and from about 7 to about 17 parts of component (e).

9. The composition of claim 6, wherein said composition comprises about 2.0 parts of component (a), about 2.0 parts of component (b), about 2.0 parts of component (c), about 0.9 part of component (d) and about 75 parts of component (e), and wherein said siloxane resin is a silanol-functional copolymer and said R group of component (c) is 2-ethylhexyl.

10. The composition of claim 1, further comprising an effective oleophobing amount of a fluorochemical compound.

11. The composition of claim 2, further comprising an effective oleophobing amount of a fluorochemical compound.

12. The composition of claim 3, further comprising an effective oleophobing amount of a fluorochemical compound.

13. The composition of claim 4, further comprising an effective oleophobing amount of a fluorochemical compound.

14. The composition of claim 6, further comprising an effective oleophobing amount of a fluorochemical compound.

15. A method for cleaning and waterproofing textiles comprising: applying to a soiled textile an effective amount of a liquid to aid soil removal, removing from the textile a combination of soil and the liquid and drying the textile, wherein said liquid is the composition of claim 1.

16. A method for cleaning and waterproofing textiles comprising: applying to a soiled textile an effective amount of a liquid to aid soil removal, removing from the textile a combination of soil and the liquid and drying the textile, wherein said liquid is the composition of claim 2.

17. A method for cleaning and waterproofing textiles comprising: applying to a soiled textile an effective amount of a liquid to aid soil removal, removing from the textile a combination of soil and the liquid and drying the textile, wherein said liquid is the composition of claim 3.

18. A method for cleaning and waterproofing textiles comprising: applying to a soiled textile an effective amount of a liquid to aid soil removal, removing from the textile a combination of soil and the liquid and drying the textile, wherein said liquid is the composition of claim 4.

19. A method for cleaning and waterproofing textiles comprising: applying to a soiled textile an effective amount of a liquid to aid soil removal, removing from the textile a combination of soil and the liquid and drying the textile, wherein said liquid is the composition of claim 5.

20. A method for cleaning and waterproofing textiles comprising: applying to a soiled textile an effective amount of a liquid to aid soil removal, removing from the textile a combination of soil and the liquid and drying the textile, wherein said liquid is the composition of claim 6.

21. A method for cleaning and waterproofing textiles comprising: applying to a soiled textile an effective amount of a liquid to aid soil removal, removing from the textile a combination of soil and the liquid and drying the textile, wherein said liquid is the composition of claim 7.

22. A method for cleaning and waterproofing textiles comprising: applying to a soiled textile an effective amount of a liquid to aid soil removal, removing from the textile a combination of soil and the liquid and drying the textile, wherein said liquid is the composition of claim 8.

23. A method for cleaning and waterproofing textiles comprising: applying to a soiled textile an effective amount of a liquid to aid soil removal, removing from the textile a combination of soil and the liquid and drying the textile, wherein said liquid is the composition of claim 9.

24. The method of claim 10, wherein said textile is selected from the group consisting of cotton and cotton-polyester blends.

25. A method for cleaning, waterproofing and oleophobing textiles comprising: applying to a soiled textile an effective amount of a liquid to aid soil removal, removing from the textile a combination of soil and the liquid and drying the textile, wherein said liquid is the composition of claim 1.

26. A method for cleaning, waterproofing and oleophobing textiles comprising: applying to a soiled textile an effective amount of a liquid to aid soil removal, removing from the textile a combination of soil and the liquid and drying the textile, wherein said liquid is the composition of claim 11.

27. A method for cleaning, waterproofing and oleophobing textiles comprising: applying to a soiled textile an effective amount of a liquid to aid soil removal, removing from the textile a combination of soil and the liquid and drying the textile, wherein said liquid is the composition of claim 12.

28. A method for cleaning, waterproofing and oleophobing textiles comprising: applying to a soiled textile an effective amount of a liquid to aid soil removal, removing from the textile a combination of soil and the liquid and drying the textile, wherein said liquid is the composition of claim 13.

29. A method for cleaning, waterproofing and oleophobing textiles comprising: applying to a soiled textile an effective amount of a liquid to aid soil removal, removing from the textile a combination of soil and the liquid and drying the textile, wherein said liquid is the composition of claim 14.

* * * * *